US006584718B1

(12) United States Patent
Serrao

(10) Patent No.: US 6,584,718 B1
(45) Date of Patent: Jul. 1, 2003

(54) FIREARM LOCKING MECHANISM

(75) Inventor: Anthony F. Serrao, 129 Oak Manor Pl., Pittsburgh, PA (US) 15235

(73) Assignee: Anthony F. Serrao, Kensington, PA (US)

( * ) Notice: Subject to any disclaimer, the term of this patent is extended or adjusted under 35 U.S.C. 154(b) by 0 days.

(21) Appl. No.: 09/688,257

(22) Filed: Oct. 13, 2000

(51) Int. Cl.[7] ..... F41A 17/02

(52) U.S. Cl. ..... 42/70.11; 42/44; 42/66; 42/96

(58) Field of Search ..... 42/44, 66, 70.11, 42/96

(56) References Cited

U.S. PATENT DOCUMENTS

| | | | | |
|---|---|---|---|---|
| 2,479,197 A | * | 8/1949 | Garretson | |
| 2,836,918 A | | 6/1958 | Pula et al. | |
| 3,193,959 A | | 7/1965 | Jaycox | |
| 3,360,880 A | * | 1/1968 | Finnegan | |
| 4,512,099 A | | 4/1985 | Mathew | 42/1 |
| 5,048,211 A | | 9/1991 | Hepp | 42/70.11 |
| 5,115,589 A | | 5/1992 | Shuker | 42/70.11 |
| 5,138,785 A | | 8/1992 | Paterson | 42/66 |
| 5,171,924 A | * | 12/1992 | Honey et al. | |
| 5,241,770 A | | 9/1993 | Lambert | 72/70.11 |
| 5,289,653 A | | 3/1994 | Szebeni et al. | 42/70.11 |
| D361,819 S | | 8/1995 | Serrao | D22/108 |
| 5,475,994 A | * | 12/1995 | Briley, Jr. et al. | |
| 5,664,358 A | * | 9/1997 | Haber et al. | |
| 5,732,498 A | * | 3/1998 | Arregiun | |
| 5,950,344 A | | 9/1999 | Ross | 42/70.11 |

* cited by examiner

*Primary Examiner*—Michael J. Carone
*Assistant Examiner*—John Richardson

(57) ABSTRACT

A locking mechanism for a firearm which includes a rod which is threaded at both ends and extends into the bore of a barrel of a firearm and into the firing chamber. At its proximate end, the rod engages a nut which expands the fingers of a collet that engages the chamber interior wall. At the distal end of the rod a lock is engaged. As the rod is rotated about its longitudinal axis, the fingers are expanded to engage the chamber wall.

6 Claims, 6 Drawing Sheets

FIREARM LOCKING MECHANISM

BACKGROUND OF THE INVENTION

1. Technical Field

The present invention relates to firearms, and more particularly to safety mechanisms for use in firearms. Still more particularly, the present invention relates to locks for the prevention of accidental or unauthorized use of firearms which are positioned in the firing chamber or in the barrel of the firearm.

2. Background Information

A problem which has become more serious in recent years stems from the accidental or unauthorized use of firearms by children and other persons. Various devices have been suggested to alleviate this problem. Such devices have included trigger locks and other such mechanisms which attempt to prevent accidental or unauthorized firing of a firearm by incapacitating the trigger. While such trigger lock devices may provide some protection, they are not entirely satisfactory since they may allow a limited amount of trigger movement which may be sufficient to discharge a round which may be loaded in the firing chamber. Trigger lock devices may also not be effective in preventing the discharge of a chambered round which may sometimes result from a sharp jarring of a firearm as might, for example, result from its being dropped onto a hard surface.

In order to overcome the above problems with trigger locks, a number of arrangements have been proposed in which a lock is applied in the barrel and/or in the firing chamber of a firearm.

U.S. Pat. No 4,512,099 to Mathew, for example, discloses a firearm locking device in which a diagonally split sleeve affords a pair of wedges at least one of which is laterally displaced when the wedges are urged together. A cylinder lock and cams attached to a tube and coaxial actuating rod extend through the gun barrel from the muzzle to the firing chamber serve to position and actuate the wedges only in response to operation of a lock key.

U.S. Pat. No 5,048,211 to Hepp discloses a chamber and bore lock which includes a rod adapted for receipt within the barrel bore of the firearm. One end of the rod has a fixed plug with an abutting O-ring. A pair of sleeves are received upon the rod with an O-ring therebetween. A threaded cap engages an end of the rod at the muzzle of the firearm, such that threaded movement of the cap draws the plug toward the cap, urging the sleeves into compressing and radially deforming engagement with the O-rings which engage inner circumferential surfaces of the barrel bore and firing chamber of the firearm.

U.S. Pat. No 5,115,589 to Shuker discloses a device for insertion into the barrel or chamber of a firearm to prevent unauthorized use which employs a key-operated lock. The key-operated lock is rotated to cause, through a screw-thread, axial movement of an operating member with tapered surfaces which causes expansion of another component having convergent surfaces, so as to engage tightly against the walls of the chamber. The key is used both to unlock the lock and to rotate the operating member. If an attempt is made to drive the device out from the barrel end there can be teeth which spread apart to bite into the walls of the chamber.

U.S. Pat. No 5,138,785 to Paterson discloses a lock for a firearm with a revolving bullet-receiving cylinder which is insertable into one of the chambers of the cylinder when the cylinder is in an open position. The lock comprises a body, insertable through a chamber and is then expandable at a foot portion by turning a key in order to prevent withdrawal of the body. While the body remains within the cylinder, the cylinder cannot be closed and the firearm cannot be discharged.

U.S. Pat. No 5,241,770 to Lambert discloses a firearm locking device having an outer tube which slidably receives a central mandrel in complementary coaxial relationship. The outer tube includes collet spring fingers mounted at a lower distal end thereof, and the outer tube upon projection of the central mandrel therethrough effects a spreading of the collet fingers for engagement with a rear terminal end of an associated pistol cylinder or barrel of a long arm such as a rifle. The collet fingers include annular shoulders to be received within the rear face of the cylinder or chamber for locking the organization within the pistol structure. Coaxially aligned bores of the outer tube and the central mandrel when aligned permit positioning of a latch therethrough preventing removal of the assembly in a pistol.

U.S. Pat. No 5,664,358 to Haber, et al. discloses a barrel lock to be removably inserted and locked within the barrel of a hand gun to prevent the accidental and unauthorized firing of the hand gun without requiring any manufacturing changes to the gun. The barrel lock includes an expandable chamber lock that is located at the distal end of a barrel lock tube. The barrel lock tube is adapted to slide inwardly through the gun barrel to locate the chamber lock to be received in and retained at the existing bullet chamber of the gun barrel, whereby the hand gun is disabled. A combination lock cooperates with the proximal end of the barrel lock tube to prevent the barrel lock tube from being withdrawn from the gun barrel and the chamber lock from being removed from the bullet chamber until a particular predetermined combination has first been successfully dialed in.

A need still exists, however, for a firearm locking mechanism with further improved efficiencies.

SUMMARY OF THE INVENTION

It is an object of the present invention to provide a locking device for firearms which provides a high degree of security against accidental and unauthorized use.

It is a further object of the present invention to provide a firearm lock which secures the firing chamber of the firearm.

It is another object of the present invention to provide a safety lock for firearms which secures the bore of the barrel of the firearm.

It is another object of the present invention to provide a safety lock for firearms which can be quickly and efficiently removed to allow use of the firearm and which may be quickly, easily and efficiently positioned and locked into the firearm after use.

It is a further object of the present invention to provide a safety lock for firearms which is attractive and not obtrusive to the appearance of the firearm.

It is still a further object of the present invention to provide a safety lock for firearms which is adapted for use with various types of firearms, including various calibers and barrel lengths which may be employed in firearms.

These and other objectives are met by the present invention which is a bore and chamber locking mechanism for a firearm which is installed through the bore into an empty chamber. The mechanism is securely locked by turning a matching security key clockwise until chamber and bore are blocked and locked. Any attempt to load a cartridge into empty firing chamber will not be possible.

In a preferred form, this locking mechanism has a proximate firing chamber. A barrel extends forward from this firing chamber to a distal end and has a bore interior dimension which is smaller than said breech chamber interior dimension. There is a shoulder between this firing chamber and the barrel section. A rod extends through the bore from the proximate end to said distal end. Expansion means are positioned in the chamber and are connected to the proximate end of the rod. In an expanded position, the expansion means engages the shoulder. In an unexpanded position, the shoulder is not engaged so that the mechanism can be inserted or withdrawn from the firearm.

Also encompassed within the scope of this invention is a method of selectively disabling a firearm. In this method, a rod is positioned to extend interiorly through the bore of the barrel at the proximate to the distal end. Expansion means are provided at the proximate end of the rod, and these expansion means move outwardly to engage the interior wall of the firing chamber. Preferably, the shoulder between the firing chamber interior wall and the bore will be engaged. Locking means will also preferably be provided at the distal end of the barrel so that once the interior wall of the firing chamber has been engaged, the mechanism can be locked to prevent its withdrawal. When the locking means are deactivated, the expansion means may be caused to move axially inwardly to allow withdrawal of the entire locking mechanism from the firearm.

The firearm locking mechanism may also incorporate a modified security lock housed within a lock housing. The tube acts as an extension of the lock housing. The lock housing is connected by a tube to a brass collet at the chamber end of firearm lock. A collet is pressed and permanently secured to the tube. An anti-theft pin is pressed into rod between the end of the tube and the shoulder inside the collet. This pin keeps the collet expanded and locked in the chamber even if the lock and lock housing are cut off. A nut is positioned on the rod and started onto the collet. The nut is held in the collet stationary while the key is turned in the clockwise direction. As the key is turned clockwise the nut travels toward the lock housing on the threaded rod causing the fingers of the collet to expand inside the empty chamber. The shoulder at the distal end of the collet expands inside the empty chamber. The shoulder at the distal end of the collet locks into opposite shoulder of the chamber at the end of bore. A spring is set between the nut and end cap, and the spring is used to start the nut onto the threaded rod and into the collet to start locking action when the key is turned clockwise.

An end cap is pressed onto the end of the rod and permanently secured. The cap is used to hold the spring and nut in place when the lock is in an at rest, unlocked position. The key is used to turn the rod counter clockwise to move the nut down the rod through the collet away from the lock housing, thereby allowing the expanded collet to return to an unlocked position and thus, making it possible to remove the locking mechanism from the chamber and the bore. As the key is turned while holding lock housing finger and slots of collet interact with axial peripheral grooves on nut to hold the nut in stationary position and thus, letting the nut travel along the threads of the threaded rod to allow the collet either to expand or to contract depending upon which direction key is turned, i.e. clockwise to expand, counter clockwise to contact. The collet and nut preferably have six grooves and six ridges for larger caliber and gauges of firearms. The collet and the nut for smaller caliber firearms, such as 22 to 30 caliber firms, preferably have three slots and three flutes, Preferably, the parts of this locking mechanism positioned inside the firearm will be brass.

BRIEF DESCRIPTION OF THE DRAWINGS

The preferred embodiment of the invention, illustrative of the best mode in which applicant contemplated applying the principles, is set forth in the following description and is shown in the drawings and is particularly and distinctly pointed out and set forth in the appended claims.

DESCRIPTION OF THE PREFERRED EMBODIMENTS

Figure 1:
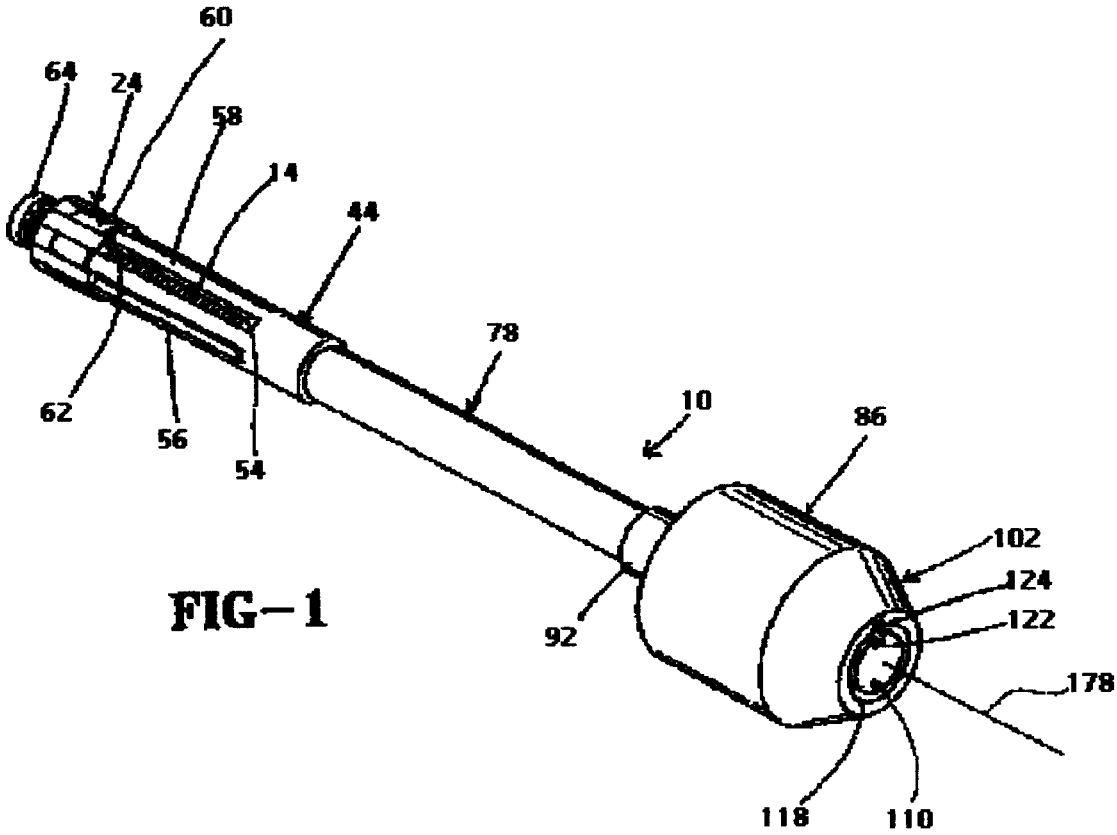
FIG. 1 is a front and side perspective view of a preferred embodiment of a firearm locking mechanism of the present invention.
Figure 2:
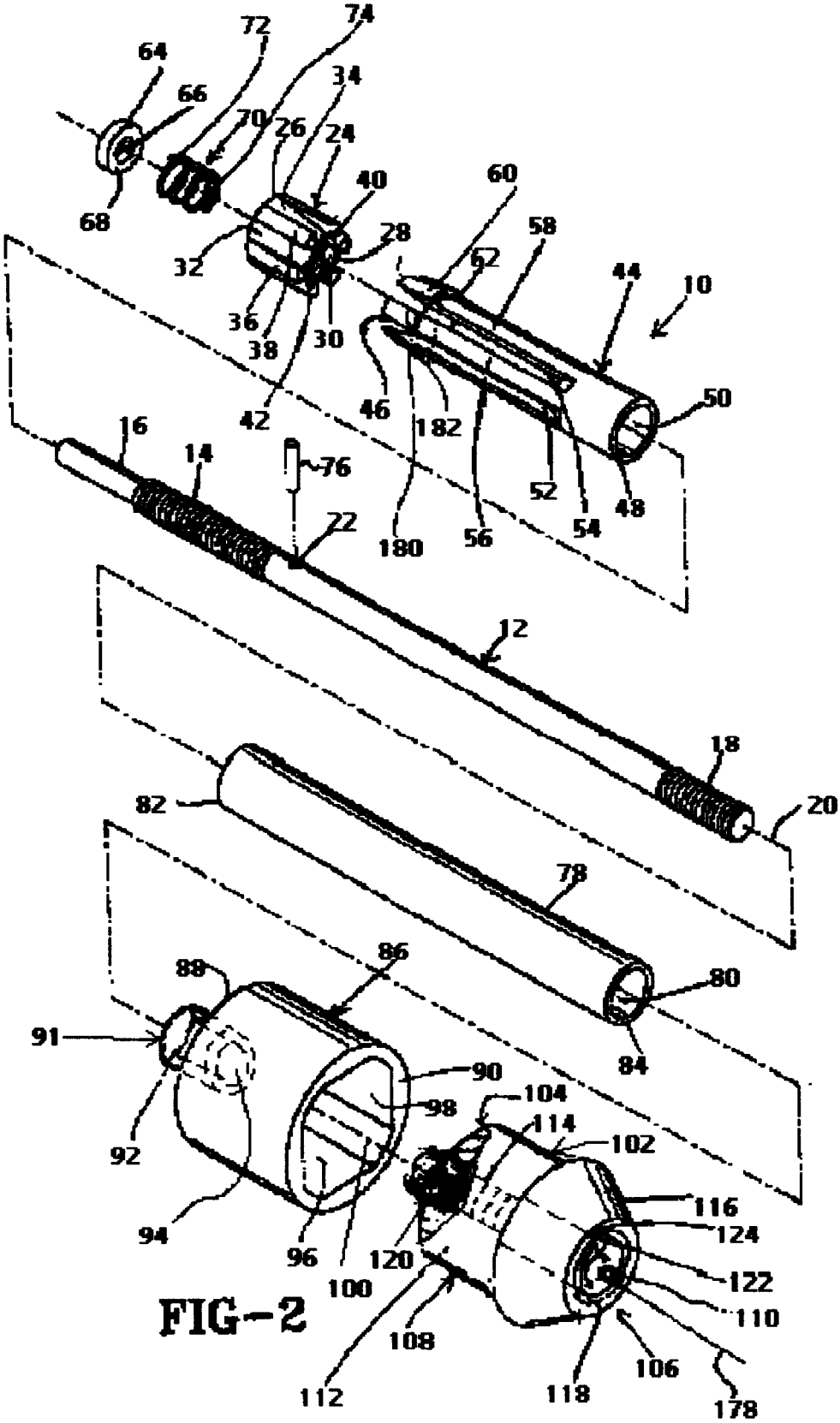
FIG. 2 is an example partially cut away perspective view of the firearm locking mechanism shown in FIG. 1.

Referring to FIGS. 1–2, the locking mechanism is shown generally at numeral 10 and included a central rod 12 which has a proximate end thread 14, a proximate and extension 16, an distal end screw thread 18, a longitudinal axis 20, and a transverse aperture 22. It will be understood that the length of the rod 12 will be select based on the barrel length of the particular firearm for which the locking mechanism is intended for use. The locking mechanism 10 also includes a tapered nut 24 which has a proximate 26 and distal side 28. The nut 24 axial grooves as at grooves 32 and 34. Between these grooves there are axial peripheral ridges as at ridges 36 and 38. Each of these axial grooves as at groove 34 has a sloped base surface 40 which 51 downwardly from the proximate end 26 to the distal end 28 of the nut 24. Each of the ridges at ridge 36 has a side as at side 42 which is canted outwardly from its base to is periphery. The locking mechanism 10 also includes a collet shown generally at numeral 44 which has a proximate end 46 and a distal end 48 and an axial bore 50 which extends between said ends. A collet 44 also has a plurality of axial slots 52 and 54 which extend rearwardly from the proximate end 46 to medial position short of the distal end 48. These axial slots as at 52 and 54 form a plurality of axial fingers as at axial fingers 56 and 58. Each of these axial fingers has a terminal wedge as at terminal wedge 60 which is configured to fit into one of the peripheral grooves as at peripheral groove 34 on the nut 24. Each of the terminal wedges as at terminal wedge 60 also has a distal shoulder as at shoulder 62, the function of which will be explained below. The locking mechanism also includes an end cap 64 with a central aperture 66. There is a distal face 68 on the end cap 64 which bears against an axial spring 70 on the proximate end 72 thereof. There is also a distal end 74 of the axial spring 70 which bears against the proximate end 26 of the tapered nut 24. A transverse pin 76 is positioned against the transverse aperture 22 of the central rod 12. There is a tube 78 having an axial bore 80 and a proximate end 82 and a distal end 84 which is concentrically positioned around the rod 12 and is retained in position by the transverse pin 76 as is explained in greater detail hereafter. Adjacent the distal end 84 of the tube 78 there is a lock housing shown generally at numeral 86 which has a proximate end 88 and a distal end 90. At the proximate end 88 there is an axial tube engagement feature 92 which has a central bore 94. The tube engagement cylinder 92 concentrically overlaps the tube 78 to secure the tube 78 to the housing 86 by a friction fit while rod 12 extends through the axial bore 94. The proximate end 82 of tube 78 abuts transverse pin 76 inserted through aperture 22 of rod 12. On its distal end 90, housing 86 has a lock receiving recess 96 which has four major sides as at major side 98 and four minor sides as at minor side 100 interposed between said major sides. A lock assembly, shown generally at numeral 102 which has a proximate side 104 and a distal side 106 fits into the recess 96 of the housing 86 at its proximate end 104. Comprised of a stationary housing engagement member 108 which remains fixed relative to the housing 86 and a axial cylindrical member 110 which is rotatable relative to the housing 86 and the stationary housing engagement member 108. The stationary housing engagement member has four rear major sides as at side 112 and four rear minor side as at side 114 wherein each of the minor sides is interposed between two of the major sides and each of the major sides as at side 112 will abut one of the major sides as at side 98 in the recess 96 and each of the minor sides as at side 114 will abut one of the minor sides as at side 100 in the recess. The minor sides may have a plurality of transverse ridges to improve the adherence of the stationary housing engagement member 108 to the recess 96 of the housing 86. The stationary housing engagement member 108 also includes a front truncated cone shaped shoulder 116 which abuts the distal end 90 of the housing 86. Between the axial cylindrical rotatable member 110 and the stationary housing engagement member 108 there is a concentric space 118 which facilitates pivoting of the axial cylindrical member 110 relative to the stationary housing engagement member 108 as will be explained hereafter. There is a threaded axial bore 120 on the axial cylindrical rotatable member 110 which is engagable with the distal thread 18 on the rod 20 as will be explained hereafter. On the axial cylindrical rotatable member 110 there is a key alignment slot 122 adjacent the cylindrical space 118. On the stationary housing engagement member 108, there is a key alignment slot 124 adjacent the concentric space 118 and in a locked position aligned with the key alignment slot 112 on the axial cylindrical rotatable member 110. A suitable lock assembly 102 is commercially available from American Lock Co. located at 3400 West Exchange, Crete, Ill. 60417 USA under model no. 8068.

At least the components of the firearm locking mechanism which are to be used inside the bore and firing chamber of the pistol 138 will preferably be machined from brass. Those skilled in the art will appreciate that other, relatively soft and flexible corrosion resistant metals may be used, although it has been found that aluminum will be generally unsatisfactory due to the possibility of a deleterious reaction with steel used in the chamber wall and barrel. Those skilled in the art will also appreciate that various engineering plastics may be used for the components of this locking mechanism, although care should be taken to select such a plastic material which will not tend to produce shavings or other particles or debris during insertion or removal from the firearm which might tend to foul the firing mechanism or the ammunition loading or ejection mechanism which might be used in any particular firearm.

The locking mechanism 10 described above, may be assembled by first positioning the pin 76 in the transverse aperture 22 of the rod. The collet 44 may be positioned to the proximate side of this pin 76 and the nut 24 may be engaged with the proximate thread 14 on the rod 12. The spring 70 may then be positioned from the proximate side of the rod 12 and the end cap 64 may then be positioned on the proximate extension 16 of the rod. The tube 78 may then be positioned to the distal side of the pin 76. The lock assembly 102 may then be positioned in the housing 86 and the tube 78 may be engaged at its distal end 84 with the tube engagement feature 92 on the housing 86 and the distal thread 18 on the rod 12 may be engaged with the threaded axial bore 120 on the lock assembly 102.

Mode of Operation

Referring to FIGS. 3–9, the firearm locking mechanism 10 is operated with a key shown generally at numeral 126. This key has a key alignment blade 128 which is insertable into the aligned key alignment slots 122 and 124 (FIGS. 1–2) on the lock assembly 102. Key 126 has a cylindrical front end on which blade 128 is positioned and adjacent blade 128 there are a plurality of key features as at features 130, 132 and 138 which allow key 126 to be operable with lock assembly 102. Key 128 also has key handle 136 by means of which it can be inserted into concentric space 118 (FIG. 2) in lock assembly 102.

Figure 3:
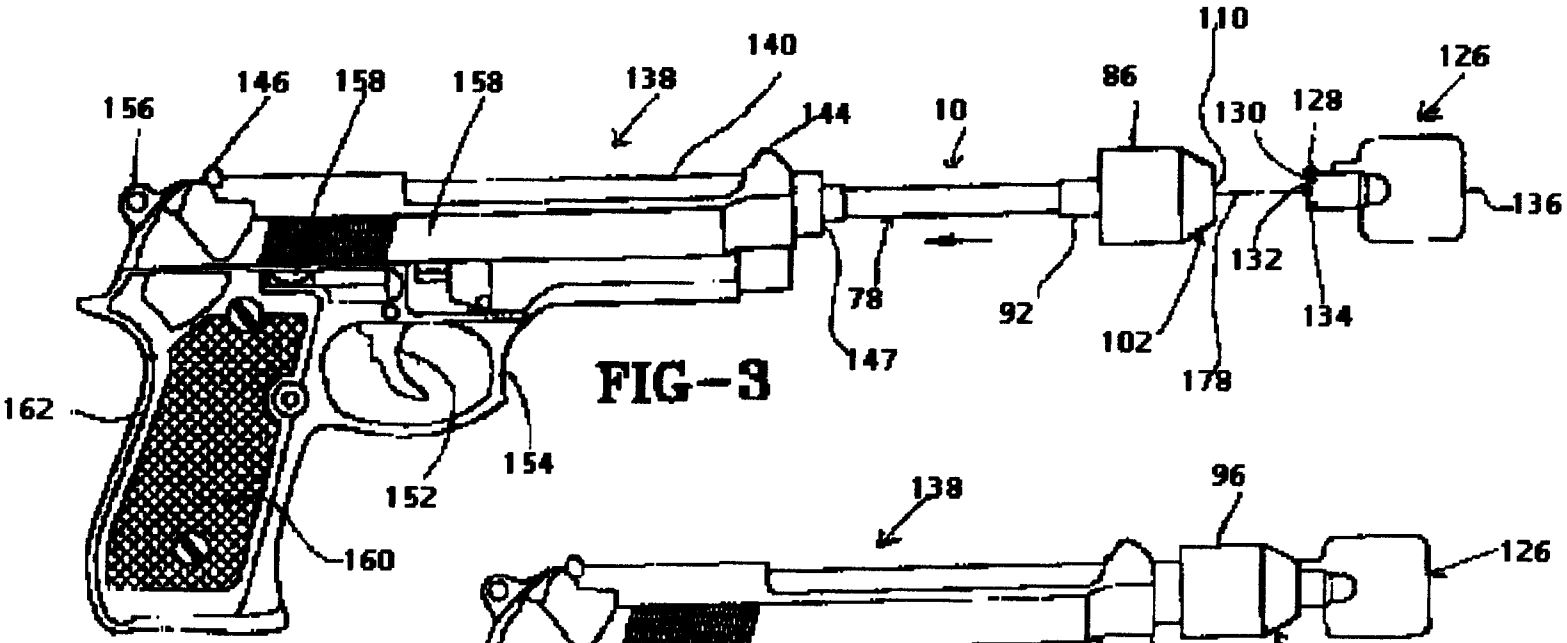
FIGS. 3–5 are sequential side elevational views of the firearm locking mechanism shown in FIG. 1 in conjunction with a pistol which illustrates the installation of the mechanism in the pistol.

Referring particularly to FIG. 3, the first step in inserting a locking mechanism 10 is illustrated. In this step, the locking mechanism 10 is used with a pistol shown generally at numeral 138. As is conventional, pistol 138 includes a barrel 140 which has a bore 142 (FIGS. 6–7) along with front and rear sights 144 and 146 respectively. As is shown in FIG. 3, the locking mechanism is first inserted into the pistol 138 through the distal opening 147 of the bore 142 in the barrel 140. Outwardly of the barrel 140 there is a slide 150. There is a trigger 152 surrounded by a trigger guard 154 which operates a hammer 156. A safety latch 158 locks the slide 150. There is a hand grip 160 and an additional pressure safety 162 adjacent the hand grip 160.

Referring particularly to FIGS. 5–9, at the proximate end of the barrel 140, there is a firing chamber 164. At its proximate opening 165, the bore 142 is in communication with the firing chamber 164. The firing chamber 164 is surrounded. by a chamber wall shown generally at 166. The chamber wall 166 includes opposed lateral walls 170 and 172 which extend in a proximate direction to connect with the firearm frame (not shown) as is conventional. Immediately adjacent the proximate opening 165 of the bore 142 of the barrel 140 there is a shoulder 174 peripherally surrounding the bore 142.

Figure 4:
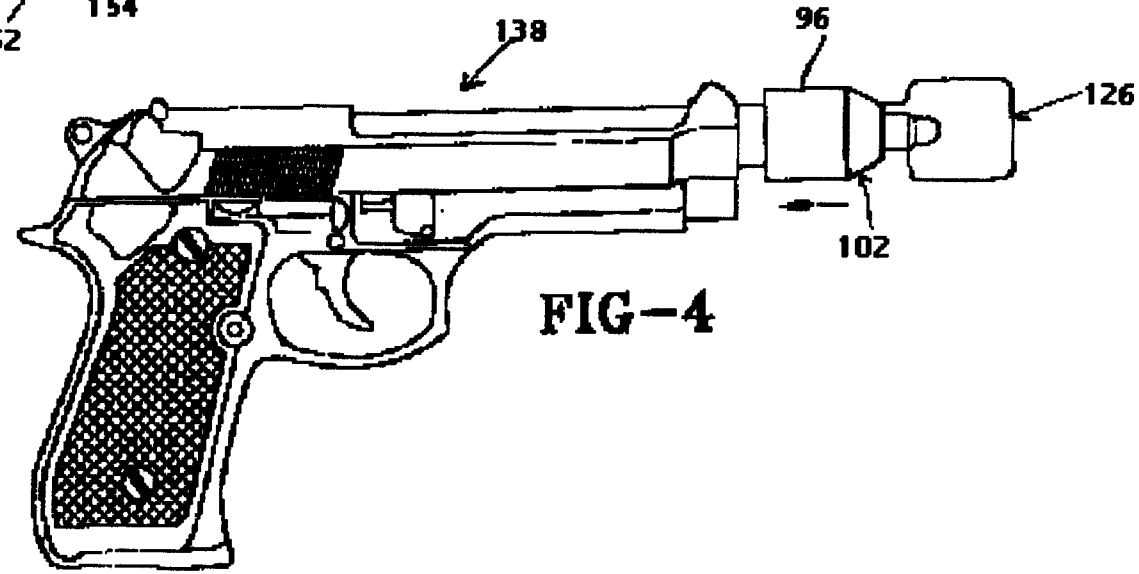
Figure 5:
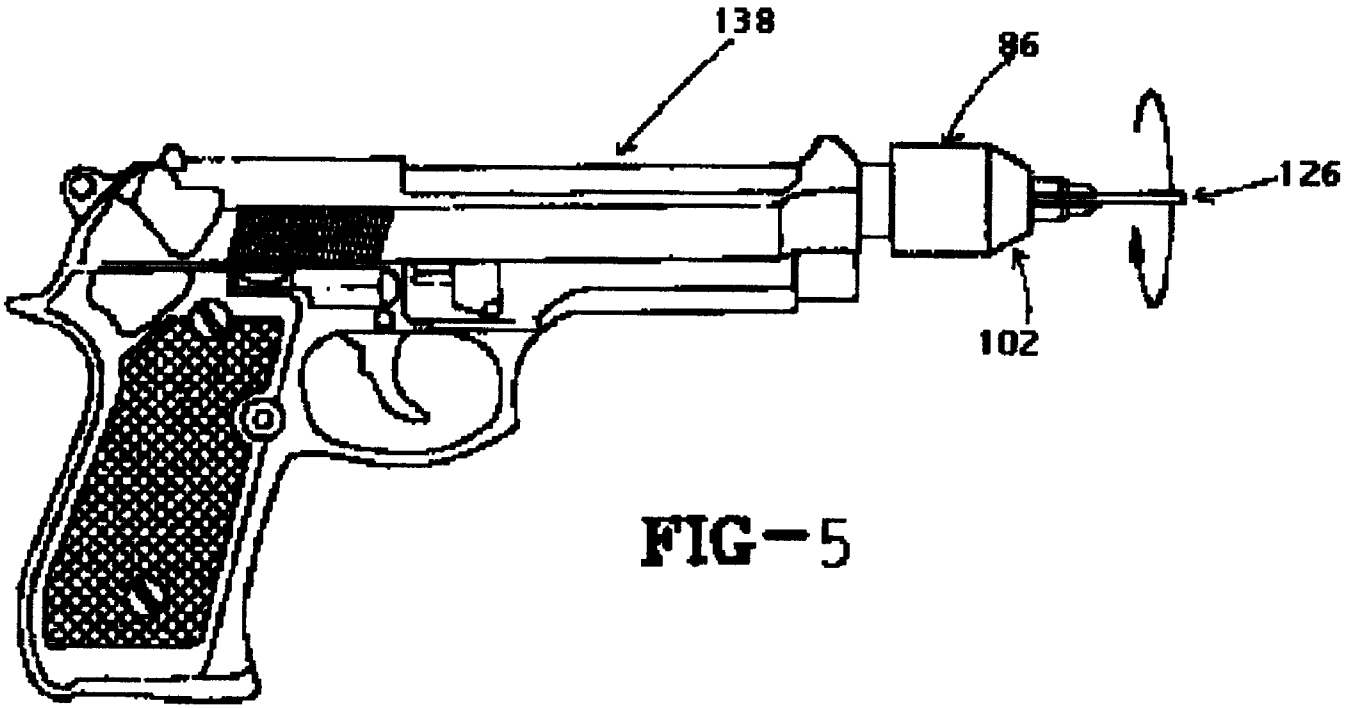
Figure 6:
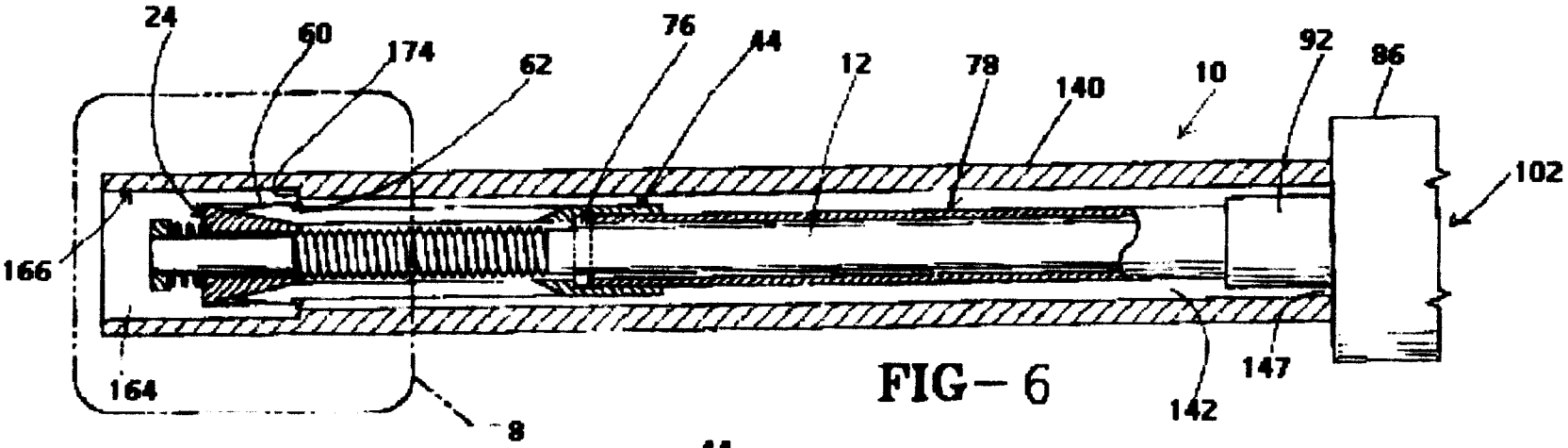
FIG. 6 is a schematic vertical cross sectional view corresponding to FIG. 3 which shows the relative positioning expansion means the firing chamber in an unexpanded unlocked position.
Figure 7:
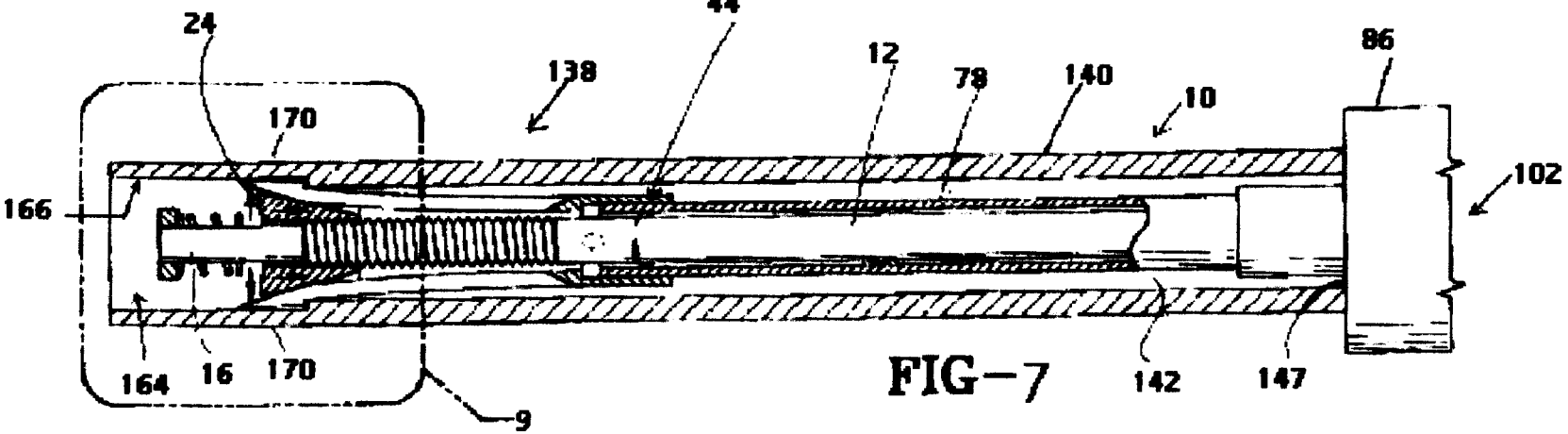
FIG. 7 is a schematic vertical cross sectional view which shows the relative positioning of the expansion means in the firing chamber in an expanded locked position.
Figure 8:
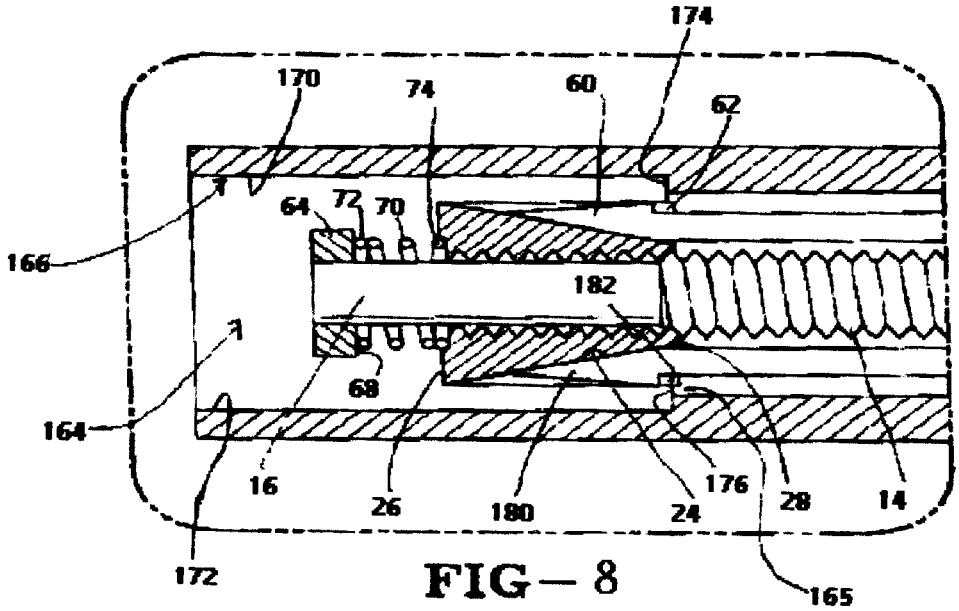
FIG. 8 is a detailed view of area 8 in FIG. 6.
Figure 9:
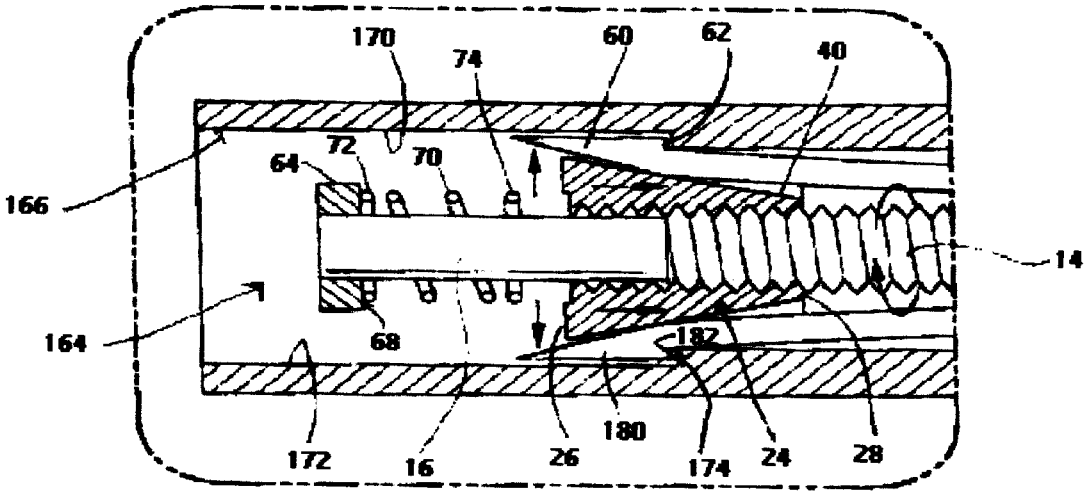
FIG. 9 is a detailed view of area 9 in FIG. 7.

Referring particularly to FIGS. 4, 6 and 8, the next step in the installation of the locking mechanism 10 in the pistol 138 involves continuing to apply axial force on the locking mechanism 10 until the proximate end 104 of the lock assembly 102 abuts barrel 140. At this point, the proximate end of the locking mechanism including the proximate extension 16 of the rod 12, the end cap 64, axial spring 70, nut 24, and terminal wedges as at wedge 60 of the collet 44 are positioned in the firing chamber 164 of the pistol 138. It will be noted that this stage in the installation of the firing mechanism 10, the terminal wedges as at wedge 62 are axially spaced from the lateral walls 170 and 172 of the chamber wall 166. It will also be observed that at this point the shoulders of the terminal wedges as at shoulder 62 are approximately aligned with the shoulder 174 on the distal wall 176 of the chamber 164. As is conventional for the type of lock used in lock assembly 102 and key 126, after the key alignment blade 128 has been aligned with the key alignment features 122 and 124 the key is inserted into the concentric space 118. If key features 130, 132 and 134 appropriately match similar features (not shown) on the lock assembly 102, the key 126 may be seated in the concentric space 118 and pivoted thereon to cause the axial cylindrical rotatable member 110 of the lock assembly 102 to also pivot about its longitudinal axis 178. It will be appreciated that when the axial cylindrical rotatable member 110 rotates about the longitudinal axis 178 that the rod 12 which is connected to the axial cylindrical rotatable chamber 110 will also rotate about its longitudinal axis 20. Such rotation will advance the rod 12 on the tapered nut 24 so that the proximate extension 16 of the rod 12 advances further into the firing chamber 164. Such advancing of the proximate thread 14 of the rod on the tapered nut 24 results in the fingers as at fingers 56 and 58 of the collet 44 being axially expanded toward the lateral walls 70 and 72 respectively of the chamber wall 166. Such expansion will continue until the terminal wedges as at wedge 60 of the fingers as at finger 56 abut the lateral walls as at lateral wall 70 and the shoulders of the terminal wedges as at shoulder 62 abut the shoulder 174 of the distal wall 176 of the chamber wall 166. Such advancing also results in the spring 70 expanding from a compressed to an expanded position. It will be understood that all the terminal wedges on the axial fingers of the collet 44 are similarly positioned, for example, terminal wedge 180 on axial finger 56 abuts lateral wall 172 while the shoulder 182 thereon abuts shoulder 174 on distal wall 176. It will be appreciated that when the locking mechanism 10 is in the position shown in FIGS. 7 and 9, it will be secured in the chamber 164 of the pistol 138 because the fingers have been engaged with the chamber wall 166, and in particular because of the wedges and particularly the wedge shoulders are engaged with the lateral wall and the shoulder of the distal wall. In this position, it would be impossible to chamber a cartridge for firing. Furthermore, after the key 126 has been removed from the lock assembly 102, it would also not be possible to remove the locking mechanism 10 from the pistol 138. In order to remove the locking mechanism 10 from the pistol 138 to allow firing of the pistol, the user would merely reinsert the key and rotate the key in a counterclockwise direction to rotate the axial cylindrical rotatable member 110 and the rod 12 counterclockwise about their longitudinal axes and thereby displace the proximate thread 14 of the rod 12 distally on the tapered nut 24 so as to allow the fingers as at axial fingers 56 and 58 to compress so that the terminal wedges as at wedge 60 and 180 disengage with the shoulder 174 of the distal wall. After the shoulders as at shoulders 62 and 184 respectively of wedges 60 and 180 are removed from the shoulder 174 and the lateral sides of the wedges 60 and 180 clear the barrel 140 the entire locking mechanism 10 may be withdrawn through the bore 142 by applying outward axially force thereon. It will be appreciated that the firearm locking mechanism of the present invention for a firearm will be securely locked.

For the purpose of this disclosure, the term "proximate", as used herein, means the end of a firearm adjacent the user of the firearm, or in the case of the locking mechanism described here, the end of the locking mechanism adjacent the user of the firearm when that locking mechanism is installed in a firearm. For the purposes of this disclosure, the term "distal" as used herein, means the end of the firearm away from the user of the firearm and in the direction of fire, or in the case of the locking mechanism described herein away from the user and in the expected direction of fire, where the locking mechanism not being used when that locking mechanism is installed in the firearm. For the purpose of this disclosure, the term "firearm" means any pistol, revolver, rifle, or shotgun from which a projectile is fired as a result of the detonation of an energetic composition. Those skilled in the art will also appreciate that the locking mechanism described herein may also be employed in larger caliber and/or crew-served weapons such as grenade launchers, machine guns, antitank guns, antiaircraft guns, mortars, and artillery weapons, and such weapons are intended herein to be encompassed within the term "firearm". To the extent that the term "breech" is more commonly used than the term "firing chamber" or "chamber" in any of the above mentioned classes of weapons, the terms "firing chamber" or "chamber" will be considered to encompass the term "breech" for the purposes of this disclosure.

This mechanism can be removed easily with the correctly matched security key and the firearm is ready for use. The firearm locking mechanism can be used in a variety of different calibers. It can not be forcibly removed form the chamber. When installed in a revolver, the cylinder can not be opened, the hammer can not be cocked and the trigger can not be pulled. With a semiautomatic or other similar action, the action will jam when operated until the lock is removed, but will not cause damage to the firearm.

It will be appreciated that a locking device for a firearm has been described which provides a high degree of security against accidental and unauthorized use of the firearm.

It will also be appreciated that a locking device for a firearm has been described which secures the firing chamber of the firearm.

It will also be appreciated that a locking mechanism for a firearm has been described which secures the bore of the barrel of the firearm.

It will also be appreciated that a locking mechanism for a firearm has been described which can be quickly and efficiently removed to allow use of the firearm and which may be quickly, easily and efficiently positioned and locked into the firearm after use.

It will also be appreciated that a locking mechanism for a firearm has been described which is attractive and not obtrusive to the appearance of the firearm.

It will also be appreciated that a locking mechanism for a firearm has been described which is adapted for use with various types of firearms, including the various calibers and barrel lengths which may be conventionally employed in firearms.

Accordingly, the improved FIREARM LOCKING MECHANISM apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the FIREARM LOCKING MECHANISM is constructed and used, the characteristics of the construction, and the advantageous new and useful results obtained; the new and useful structures, devices, elements, arrangements, parts, and combinations are set forth in the appended claims.

What is claimed is:

1. A locking mechanism in combination with a firearm having a firing chamber with an interior wall and a barrel having a proximate end and a distal end and extending from said firing chamber the distal end and said barrel having an interior bore which communicates with said firing chamber such that there is a shoulder between said firing chamber interior wall and said bore, said lock comprising:

a rod extending through said bore of said barrel from said proximate end to said distal end;

and expansion means consisting of a collet, nut, spring, end cap and threaded rod positioned in said firing chamber and connected to the proximate end of the rod and being positionable in an expanded position to engage the firing chamber interior wall to disable the firearm from firing, Wherein in an unexpanded position the expansion means is disengaged from the firing chamber interior wall, Wherein the expansion means engages the shoulder between said firing chamber and said bore, Wherein the rod has a longitudinal axis and the rod is rotated about said longitudinal axis to selectively move the expansion means selectively from an unexpanded unlocked position to the expanded locked position, Wherein a lock control means is operationally positioned on the distal end of the rod to manipulate the rod to selectively move the expansion means axially between the unexpanded unlocked position to the expanded locked position, Wherein at its proximate end the rod has a proximate threaded section, and the expansion means is a nut having 6 grooves and collet having 6 fingers positioned axially outwardly from the nut, and the proximate threaded section of the rod is not attached to the nut until the rod is rotated clockwise about its longitudinal axis by the lock control means causing the nut to thread onto the rod and move relative to the collet in a proximate direction to expand the fingers axially outwardly to engage the shoulder between the bore and the firing chamber interior wall, Wherein the rod has a distal threaded section and said distal threaded section is connected to the lock control means which is a key receiving means, Wherein a key is applied to the key receiving means to selectively allow the rod to be rotated about its longitudinal axis, Wherein the rod is concentrically positioned inside a tube, Wherein there is an end cap on the distal end of the rod and the end cap keeps spring and nut on rod in unlocked position.

2. Wherein the rod of claim 1, wherein there is a transverse pin on the rod and said pin prevents the rod, collet, and nut from coming unlocked in chamber if the integrity of key receiving means and housing are compromised, Wherein the key receiving means is contained in a housing, Wherein a spring is interposed between the nut and end cap, Wherein when the fingers engage the nut the spring is expanded to start the expansion means, Wherein when the nut is out of engagement with the proximate thread of the rod spring is compressed.

3. Wherein the expansion means of claim 1, wherein the fingers each have a terminal wedge and said nut has 6 sloped grooves and wherein each of said terminal wedges—and the interior wall of the firing chamber and each of said terminal wedges engages each of said sloped grooves, Wherein each of said terminal wedges has a shoulder and each of said shoulders engages the shoulder between the bore and the interior wall of the firing chamber.

4. A locking mechanism for disabling a firearm from firing comprising:

a rod having proximate and distal ends and adjacent said ends having respectively proximate and distal attachment means;

a nut having 6 axial sloped peripheral grooves positioned at the proximate end of the rod; but not attached to rod until locking means is turned clockwise;

a collet having an axial bore, a proximate end, a distal end and 6 fingers at the distal end of the collet, each of said fingers having a terminal wedge and each of said wedges having a shoulder, wherein said collet is circumferentially superimposed on the rod such that said proximate end of said collet is medially positioned on said rod and wherein each of the wedges engages one of the peripheral grooves on the nut; and a locking means fixed to the distal attachment of the rod.

5. In a firearm for propelling a projectile upon detonation of an energetic composition comprising a firing mechanism with a trigger and a hammer, a firing chamber with an interior wall, a barrel having an interior bore with a proximate and a distal opening and said bore communicating with said firing chamber at said proximate opening such that a shoulder is formed on said interior wall of said firing chamber adjacent said proximate bore opening, wherein said improvement comprises a locking mechanism comprising for, disabling the firing chamber from accepting ammunition:

a rod having a longitudinal axis and proximate and distal ends and adjacent said ends having respectively proximate and distal attachment means;

a nut positioned in the chamber of the firearm having a plurality of axial sloped peripheral grooves positioned on the proximate attachment means of the rod;

a collet having an axial bore, a proximate end positioned in the bore of the barrel of the firearm, a distal end positioned in the chamber of the firearm and a plurality of fingers at the distal end of the collet, each of said fingers having a terminal wedge and each of said wedges having a shoulder, wherein said collet is circumferentially superimposed on the rod such that said proximate end of said collet is medially positioned on said rod and wherein each of the wedges engages one of the peripheral grooves on the nut and wherein the fingers of the collet may be expanded radially to move said terminal wedges of said fingers out of engagement with the sloped groves of the nut to a position where the shoulders of said wedges engage the shoulder of the interior wall of the chamber adjacent said proximate bore opening; and a locking means positioned adjacent the distal end of the barrel fixed to the distal attachment means of the rod, wherein the rod may be rotated about its longitudinal axis when said locking means is unlocked and may not be rotated about its longitudinal axis when the locking means is locked.

6. A method of selectively disabling a firearm having a firing chamber, interior wall and a barrel having a proximate end and a distal end rod extending from said firing chamber to the distal end and said barrel having an interior bore which communicates with said firing chamber such that there is a shoulder between said firing chamber interior and said method comprising the steps of:

positioning a rod to extend interiorly through said bore of said barrel from said proximate end to said distal end;

positioning expansion means in said firing chamber by connecting said expansion means to the proximate end of the rod; and causing the expansion means to move radially outwardly to engage the interior wall of the firing chamber;

Wherein the expansion means engages the shoulder between firing chamber interior wall and the bore;

Wherein the firearm is returned to an operational condition by the first causing the expansion means to move axially inwardly to disengage from the interior wall of the firing chamber and the withdrawing the rod and expansion means from the bore;

Wherein a selective locking means is provided adjacent the distal end of the barrel and said locking means is rotated clockwise to allow outward radial movement of the expansion means to permit engagement of the expansion means with the interior wall of the chamber and said locking means is locked to prevent inward radial movement of the expansion means to thereby prevent returning the firearm to an operational condition.

* * * * *